United States Patent [19]

Nakamura et al.

[11] 4,391,512

[45] Jul. 5, 1983

[54] DEVELOPING DEVICE USING MAGNETIC DEVELOPER

[75] Inventors: Shunji Nakamura, Kawasaki; Kozo Arao, Yokohama, both of Japan

[73] Assignee: Canon Kabushiki Kaisha, Tokyo, Japan

[21] Appl. No.: 108,058

[22] Filed: Dec. 28, 1979

[30] Foreign Application Priority Data

Jan. 6, 1979 [JP] Japan ..... 54-890
Jan. 9, 1979 [JP] Japan ..... 54-1634

[51] Int. Cl.[3] ..... G03G 15/09

[52] U.S. Cl. ..... 355/3 DD; 118/657; 118/658

[58] Field of Search ..... 355/3 R, 3 DD; 118/653, 118/656, 657, 658, 661

[56] References Cited

U.S. PATENT DOCUMENTS

| | | | |
|---|---|---|---|
| 2,297,691 | 10/1942 | Carlson | 95/5 |
| 3,232,190 | 2/1966 | Willmott | 95/1.7 |
| 3,438,706 | 4/1969 | Tanaka et al. | 355/11 |
| 3,457,070 | 7/1969 | Watanabe et al. | 96/1.4 |
| 3,536,483 | 10/1970 | Watanabe et al. | 355/3 X |
| 3,666,363 | 5/1972 | Tanaka et al. | 355/10 X |
| 4,030,447 | 6/1977 | Takahashi et al. | 355/3 DD X |
| 4,071,361 | 1/1978 | Marushima | 355/3 R X |
| 4,081,571 | 3/1978 | Nishihama et al. | 118/657 X |
| 4,119,060 | 10/1978 | Mochizuki et al. | 118/653 |
| 4,126,100 | 11/1978 | Nishihama et al. | 118/658 |
| 4,233,935 | 11/1980 | Uehara et al. | 118/657 |
| 4,244,322 | 1/1981 | Nomura et al. | 118/658 |
| 4,254,202 | 3/1981 | Matsumoto et al. | 118/657 X |
| 4,286,543 | 9/1981 | Ohnuma et al. | 118/658 X |
| 4,292,387 | 9/1981 | Kanbe et al. | 355/3 DD X |

FOREIGN PATENT DOCUMENTS

| | | |
|---|---|---|
| 2810520 | 6/1979 | Fed. Rep. of Germany . |
| 53-125844 | 11/1978 | Japan . |

*Primary Examiner*—Fred L. Braun

*Attorney, Agent, or Firm*—Fitzpatrick, Cella, Harper & Scinto

[57] ABSTRACT

A developing device having a developer holding member provided in confrontation to a latent image bearing member and a doctor blade which feeds magnetic developer onto the developer holding member and regulates a layer thickness of the magnetic developer fed onto the developer holding member, wherein the developer thickness regulating doctor blade is in such a configuration that it may converge magnetic lines of force from the magnetic pole provided on the rear surface of the developer holding member and from the other magnetic pole provided in contiguity to the developer holding member surface opposite to the first-mentioned magnetic pole.

9 Claims, 9 Drawing Figures

DEVELOPING DEVICE USING MAGNETIC DEVELOPER

BACKGROUND OF THE INVENTION

1. Field of the Invention

This invention relates to a developing device, and more particularly, it is concerned with a developing device which visualizes a latent image by use of a single component magnetic developer.

2. Description of Prior Arts

For the dry developing method for developing an electrostatic pattern, there are two types from the standpoint of construction of the developing methods, i.e., two-component development method and one-component developing method. The former method uses a developing agent consisting of carrier particles such as iron powder, glass beads, etc., and toner particles which actually develop an electrostatic image. This two-component developing method has the disadvantage of downgraded image quality due to variations in the image density caused by changes in the mixing ratio between the carrier particles and the toner particles, and deterioration in the carrier particles. On the other hand, the single-component developing method is free from the deficiency of the two-component developing method, because of its absence of the carrier particles. Therefore, this latter method has high potential as the developing method of the future.

The one-component developing agent which has generally been known and used includes magnetic powder in the toner particles due to the need for providing various means such as, for example, the property of conveying the developing agent upto the developing region opposite to the electrostatic image, and the property of frictional charging by relative movement. The content of the magnetic powder is nevertheless naturally limited, because the toner is bonded onto an image transfer paper using heat, pressure, or other means so as to fix the toner image on the image transfer paper to it. Practically, the magnetic powder occupies 10 to 60% by weight of the toner particles. However, owing to the difference in the specific gravity between the resin constituting the toner and the magnetic powder, the volumetric occupying ratio of the magnetic powder in the toner particles is 20% or less. Since the volumetric occupying ratio of the magnetic powder in the toner is very low, behavior of the toner in the magnetic field, unlike the single body of the magnetic powder, makes it difficult to form a long brush of scattered density at the position of the magnetic pole. On account of this, if the thickness of the toner layer on the toner holding member is restricted to an order of a few millimeters, there tends to occur irregularity in the toner layer formed on the toner holding member, hence non-uniformity in its thickness. This non-uniformity of the toner layer on the toner holding member tends to directly reflect on the image as developed. Further, since the toner layer is generally dense, when irregularity occurs in its layer thickness, there would take place such dangers that the toner particles are coagulated by press-contact of the particles to the surface of a photo-conductive body which is the electrostatic image bearing section, or the photo-electric body itself is impaired. In this context, therefore, the developing method which utilizes the one-component magnetic toner is required to form a thin uniform layer of the toner on the toner bearing member. In general, with a view to regulating the layer thickness of the powder material on the toner holding member, when the thickness regulating member is disposed in contiguity to the surface of the holding member to form a slit, and the holding member performs its relative movement with respect to the thickness regulating member, the toner layer thickness which has been subjected to actual thickness control will be slightly thicker than the abovementioned slit interval. Under such circumstances, in the development using the one-component magnetic toner, the thickness regulating member has had to be brought very close to the toner bearing member so as to form the thin layer of the toner. On account of this, mechanical precision has been required of the developing device, and, moreover, there has taken place such situations that the toner particles which have been coagulated for various reasons come into small gap of the slit causing no toner layer formation on that specific portion. Furthermore, in spite of the fact that the developing device using the one-component magnetic toner is of a simple mechanical construction, the conventional developing devices possess some disadvantages of making it difficult to form a thin, uniform toner layer. In more detail, when the toner thickness regulating member is press-contacted to the toner layer, if the pressure is small, dropping and scattering of the toner particles increase, and, if the pressure is great, the toner particles coagulate among themselves, or they stick to the thickness regulating member or the conveying and holding member. Such coagulation and adhesion cannot be avoided in a method, in which the toner particles are caused to pass through a given gap. Such scattering, coagulation, and adhesion of the toner particles remarkably deteriorate the image as developed. Moreover, when an additional device is provided to solve the afore-described disadvantages, the advantage of the device, which is simple in construction due to use of the one-component magnetic toner, cannot be made much use of.

U.S. Pat. No. 4,081,571 and German Laid-open patent application Ser. No. 2810520 disclose a developing device having a sleeve and a doctor blade to determine thickness of a magnetic brush, wherein an element made of a magnetic material is fixedly provided on one part of the doctor blade.

Laid-open Japanese Patent Application No. 53-125844 describes a developing device of a type, wherein electrically conductive magnetic toner is adhered onto an outer peripheral surface of a fixed sleeve having a rotating magnet roll by magnetic force of the magnet roll, and the toner particles are conveyed by rotating the magnet roll to carry out the development, the layer thickness of the toner adhered onto the outer peripheral surface of the sleeve being regulated uniformly by means of magnetic force generated from the magnet roll and the magnetic body.

Further, a co-pending U.S. patent application Ser. No. 938,494, filed on Aug. 31, 1978, now abandoned, of the same assignee as that of the present application discloses an art of using one-component magnetic toner and a magnetic doctor blade and magnetic field for the uniform control of the toner layer on the sleeve.

These patents and patent application do not disclose anything about the point of improvement which is the subject matter of the present invention and described in the ensuing preferred embodiments.

SUMMARY OF THE INVENTION

It is an object of the present invention to provide a developing device which perfectly solves the disadvantages in the conventional developing device using the one-component magnetic toner.

It is another object of the present invention to provide a developing device of a simple construction so as to perform satisfactory development without causing scattering, coagulation, and adhesion of the toner particles to any part of the developing device.

It is still another object of the present invention to provide an improved developing device using a magnetic developer, wherein the shapes of the magnetic pole and a magnetic member opposite to the magnetic pole are improved so as to enable a thin layer of the magnetic developer to be formed on a supporting member.

Briefly stating a preferred embodiment of the present invention, a magnetic member is fixedly produced on the surface of a rotary non-magnetic cylinder having in its interior a fixed magnet opposite the position of the magnetic pole of the internally fixed magnet in contiguity thereto, and, with rotation of the non-magnetic cylinder, the layer thickness of the magnetic toner to be formed on the surface of the non-magnetic cylinder is made smaller than a clearance between the actual adjacent magnetic member and the surface of the non-magnetic cylinder, thereby forming a toner layer of a uniform thickness.

The foregoing objects and other objects as well as the characteristic features of the present invention will become more apparent from the following detailed description of the invention, when read in conjunction with the accompanying drawing and preferred embodiments thereof.

DESCRIPTION OF THE PREFERRED EMBODIMENTS

Figure 1:
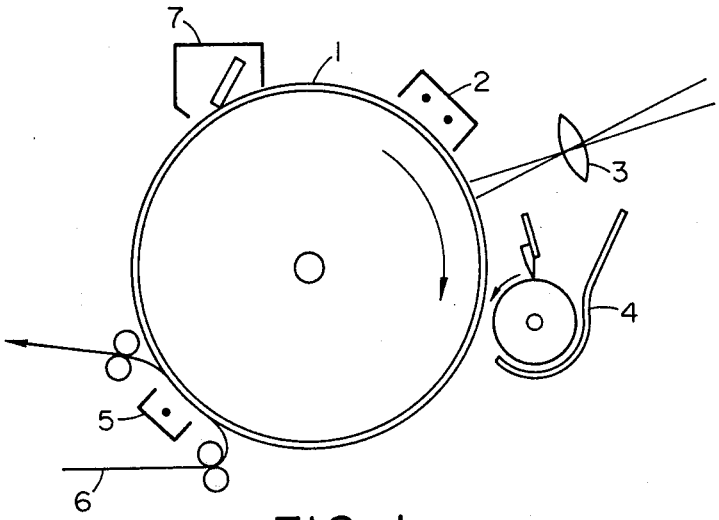
FIG. 1 is a schematic structural diagram of one example of an image forming device, to which the developing device of the present invention is applicable.

Referring first to FIG. 1 which shows one example of image reproduction or recording device, to which the developing device of the present invention is applicable (though the invention is not limited to this recording device alone), a reference numeral 1 designates a photosensitive drum including a photo-conductive layer. The photosensitive drum may or may not have an insulating layer on its surface, or may be either in a flat sheet form or in a belt form. A numeral 2 refers to a well known electric charging device for photo-sensitization, and 3 refers to a light image irradiating device which projects a light beam, etc. modulated by an original image, light image, or image signal. By these members, an electrostatic image is formed on the photosensitive member 1. For this electrostatic image forming process, there may be used the so-called "Carlson process" as described in U.S. Pat. No. 2,297,691, the processes as described in U.S. Pat. Nos. 3,438,706, 3,666,363, 4,071,361, 3,457,070, and U.S. Pat. No. 3,536,483, and others. A numeral 4 refers to the developing device according to the present invention, by which toner particle developed image can be formed in accordance with the electrostatic image on the photosensitive member 1. A reference numeral 5 designates a device for transferring the toner image onto an image transfer material 6. In some cases, electric charges is imparted to the developed image by corona discharging, prior to the image transfer, for improving its image transfer property. It is also possible to adopt the so-called electrostatic image transfer method, wherein an electrostatic image on the photosensitive member 1 is once transferred onto a separate image bearing member, and then the image is developed by the developing device 4. A numeral 7 refers to a cleaning device which removes residual toner on the photosensitive member 1 after the image transfer operation so as to enable the photosensitive member to be used again in the subsequent reproduction operation.

Figure 2:
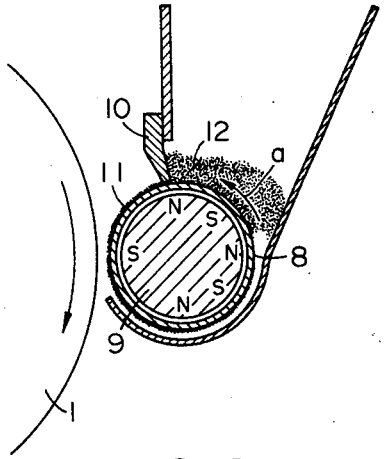
FIG. 2 is a cross-sectional view of one preferred embodiment of the developing device according to the present invention.

FIG. 2 shows one embodiment of the developing device according to the present invention, wherein a reference numeral 1 designates a photosensitive drum as an electrostatic image bearing means. A numeral 8 refers to a developer holding member provided in confrontation to the electrostatic image bearing means 1. This developer holding member is a non-magnetic cylinder (hereinafter simply called "sleeve") which rotates in the direction of an arrow a in the drawing. A reference numeral 9 designates a magnet fixedly provided within the sleeve 8. The magnet 9 has, at least, a magnetic pole which lifts up an insulative one-component magnetic developer onto the cylinder and conveys the same to the developing region, a developer coating magnetic pole, and a developing magnetic pole. A numeral 10 refers to a doctor blade which applies the magnetic toner 12 onto the surface of the sleeve 8 and regulates the thickness of the toner layer formed thereon. According to the present invention, this doctor blade 10 may be made of a magnetic material such as, magnet, iron, permalloy, and so forth. Insulative toner particles in the toner layer 11, the thickness of which has been regulated by the doctor blade 10, slidingly contacts the sleeve surface by its rotation, and is electrically charged in a polarity opposite the charge polarity of the latent image by friction therebetween. Thereafter, the toner layer reaches the developing region where the electrostatic charge pattern on the photosensitive drum 1 is visualized.

Figure 3:
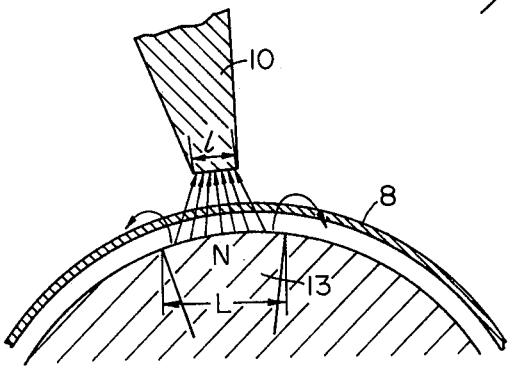
FIG. 3 is an enlarged view, in cross-section, showing a magnetic blade section in the developing device according to the present invention.

FIG. 3 is an enlarged diagram showing the toner layer thickness control section in the developing device according to the above-described embodiment of the present invention, wherein a reference numeral 13 designates a fixed magnet provided in confrontation to the doctor blade 10 in the sleeve 8. The magnetic poles of this fixed magnet 13 is directed to the doctor blade 10. In this instance, the magnetic lines of force due to the magnet 13 reaches the surface at the tip end of the magnetic blade 10 which opposes the sleeve 8. In case the doctor blade is non-magnetic, only the force of attraction to the surface of the toner holding member 8 (magnetic force, electrostatic adsorption force, van der Waal's force, etc.) exerts onto the magnetic toner, hence the toner layer formed along rotation of the sleeve becomes thick. Accordingly, it is necessary that a force to separate the magnetic toner from the surface of the rotating sleeve be exerted at the thickness control section.

The magnetic powder is subjected to force in the magnetic field where the density of the magnetic lines of forces changes from sparse to dense, i.e., where the magnetic flux density gradient is present. Consequently, when the doctor blade 10 is made of a magnetic material, at least the following relationship should be established between the tip end width l of the magnetic blade and the pole width L of the fixed magnet in the sleeve 8 for the magnetic toner to receive a force of attraction from the surface of the sleeve 8 to the side of the doctor blade:

$$l \leqq L$$

As the value of l becomes smaller and smaller than the value of L, the magnetic lines of force concentrates on the magnetic blade, and the toner layer control becomes effective by this magnetic force.

Figure 4:
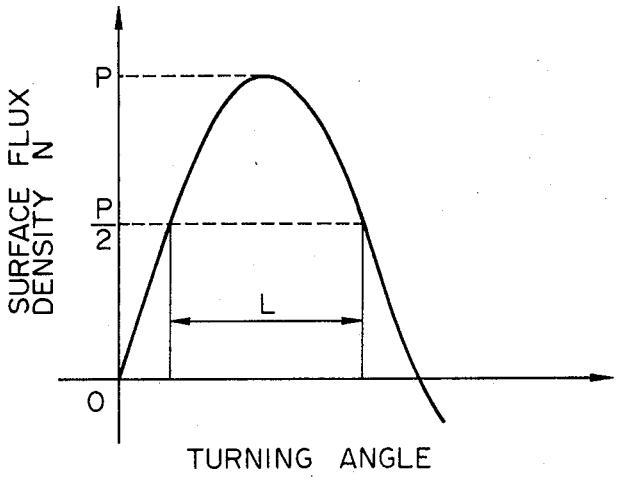
FIG. 4 is a graphical representation to explain how the width of the magnetic pole is determined.

In the case of the construction as shown in FIG. 2 wherein the magnet roll 9 has been magnetized in six magnetic poles of N-S-N-S-N-S, the width L of the magnetic pole of the fixed magnet in the sleeve 8 is determined in such a manner that, as shown in FIG. 4, the surface magnetic flux density distribution of the magnet is first drawn, from which half value of the peak in the surface magnetic flux density distribution of the magnetic poles corresponding to the tip end of the abovementioned magnetic blade (in the illustrated case, it is "N") is found, and this half value is made the abovementioned width, i.e. half a peak width, of the magnetic pole L.

It has been found out as the result of experiments that the width l of the tip end of the magnetic blade should preferably be selected from a range of 0.1 mm to 5 mm, and the width L of the magnetic pole of the fixed magnet at a position corresponding to the tip end magnetic pole be selected with a numerical value satisfying $l \leqq L$ from a range of from 0.1 mm to 1.5 mm. Particularly, in order to form a uniform and thin layer as the developer layer, it is preferable that the value of the width l be selected so as to satisfy the relationship of $l \leqq L$ from a range of 0.5 mm to 1 mm, and the value of the width L from a range of 0.5 mm to 10 mm.

According to the above-described embodiments of the present invention, it is possible to form a uniform toner layer which is thinner than the toner layer control slit, thereby facilitating realization of the developing device for the one-component magnetic toner.

Figure 5:
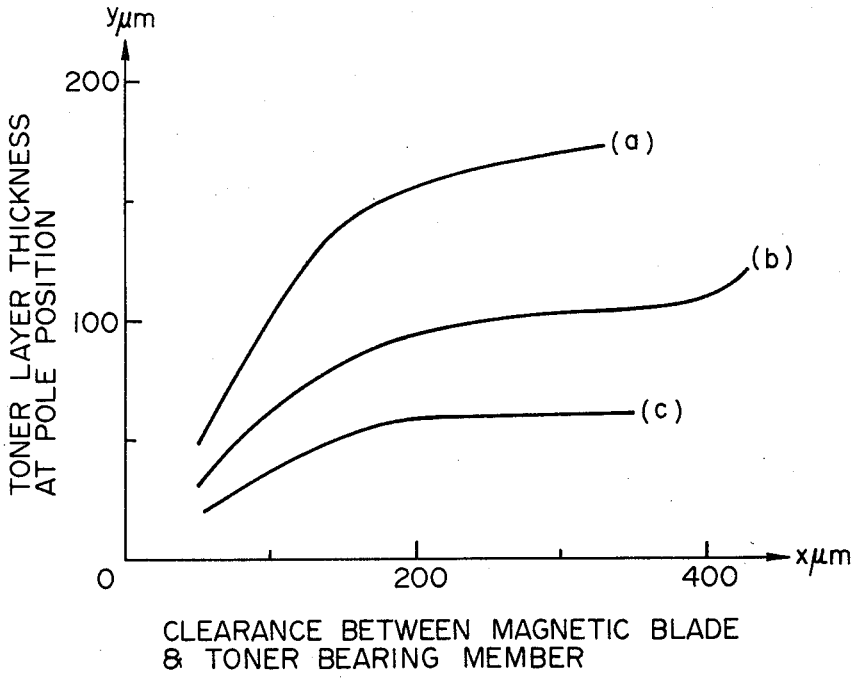
FIG. 5 is also a graphical representation of data showing the relationship between the toner layer thickness at the position of the magnetic pole and the clearance between the magnetic blade and the toner bearing member.

FIG. 5 indicates experimental data for a relationship of a clearance between the magnetic blade and the toner holding member with respect to the toner layer thickness at the position of the magnetic pole. Using three kinds of insulative one-component magnetic toner as examples, the toner layer thickness (y-axis) at the position of the magnetic pole on the toner holding means with respect to a clearance (x-axis) between the doctor blade of iron and the toner holding means has been measured.

For the toner, the following materials are used:

(a) a mixture of 55 parts by weight of polyester, 20 parts by weight of magnetite, 2 parts by weight of carbon, and 2 parts by weight of electric charge controlling agent, to which 0.1% of colloidal silica has been added;

(b) a mixture consisting of 50 parts by weight of polystyrene, 40 parts by weight of magnetite, 3 parts by weight of electric charge controlling agent, and 6 parts by weight of carbon, to which 0.1% of colloidal silica has been added; and (c) a mixture consisting of 50 parts by weight of polystyrene, 40 parts by weight of magnetite, 3 parts by weight of electric charge controlling agent, and 6 parts by weight of carbon.

The magnet is so disposed that its magnetic pole may be at the closest point between the electrostatic image bearing member and the toner holding member, the surface magnetic flux density of which at that time is made 800 gausses.

As is apparent from the graphical representation, when the gap between the doctor blade 10 and the toner holding member 8 is in a range of from approximately 50 to 200 microns, the toner layer thickness increases as the gap becomes wider. On the other hand, when the gap is in a range of approximately 200 to 350 microns, the toner layer thickness does not so much increase as the gap between them increases, i.e., it remains almost unchanged, or increases slightly. It is also seen that the toner layer thickness per se (at the position of the magnetic pole) is always thinner than the abovementioned gap.

In the following preferred embodiments of the present invention will be described in reference to FIGS. 6, 7, 8 and 9 of the accompanying drawing.

For the developing method using the one-component magnetic toner, there is what is called "jumping development" (vide, for example, U.S. Pat. No. 3,232,190). According to this developing method, toner is thinly and uniformly applied onto the surface of the toner holding member, after which it is opposed to an electrostatic latent image. In this instance, a space gap is provided between the surface of the toner layer and the surface of the electrostatic image. On account of this, no toner directly contacts the non-image portion of the electrostatic image, hence no fogging phenomenon takes place in the developed image. In this developing method, however, it is not preferable for flight of the toner particles to take a wide gap between the electrodes, because the toner particles are subjected to force by an electric field created between the electrostatic latent image and the sleeve functioning as the developing electrode (the electric field may also be auxiliarily energized by application of a bias field). The electrode gap is in general a few hundred microns or so. Accordingly, it is necessary to form the toner layer to be thinner than the electrode gap, but, using the developing device of the present invention, the toner layer of the required thickness can be readily formed.

In the experiments conducted by the present inventors, the following established values were used.

| | |
|---|---|
| Magnetic flux density of the fixed magnet in the non-magnetic sleeve | 1,000 gausses |
| Width L of the magnetic pole of the fixed magnet | 5 mm |
| The magnetic blade as the layer thickness controlling member | iron-made |
| Width l of the magnetic pole at the tip end of the blade | 0.5 mm |
| Gap between the magnetic blade and the surface of the sleeve | 300 microns |
| Gap between the photosensitive drum and the sleeve at the developing region | 300 microns |

The insulative magnetic toner used consists of 3 parts by weight of styrene/maleic acid as the resin component and 1 part by weight of magnetite, which are well mixed and pulverized into fine powder having an average particle diameter of 8 microns or so. The thickness-controlled toner layer is generally 100 micron in thickness. When the sleeve and the photosensitive drum are rotated at an equal peripheral speed (110 mm/sec.), a favorably developed image can be obtained.

Figure 6:
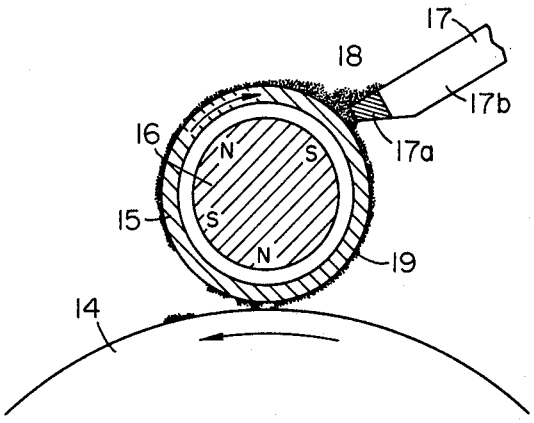
FIG. 6 is an explanatory diagram of another embodiment of the developing device according to the present invention.

FIG. 6 shows another embodiment of the developing device according to the present invention. In the drawing, a reference numeral 14 designates a photosensitive drum as the electrostatic latent image bearing means. A numeral 15 refers to a non-magnetic cylinder (hereinafter simply called "sleeve") which is disposed in confrontation with the electrostatic image bearing means 14 as the developer holding member, and rotates in the arrowed direction. A numeral 16 refers to a magnet fixedly provided within the sleeve 15. The magnet has, at least, magnetic poles which serve to hold the developer 18 on the sleeve 15 and to convey the same upto the developing region. A reference numeral 17 designates the doctor blade which applies the insulative magnetic toner 18 onto the surface of the sleeve 15, and regulates thickness of the toner layer to be formed. According to this embodiment, the doctor blade 17 is made of a magnetic material at least at its tip end part 17*a*. The toner layer 19 of uniform and thin thickness formed by the doctor blade 17 reaches the developing region by rotation of the sleeve 15 and visualizes the electrostatic charge pattern on the photosensitive drum 14.

Figure 7:
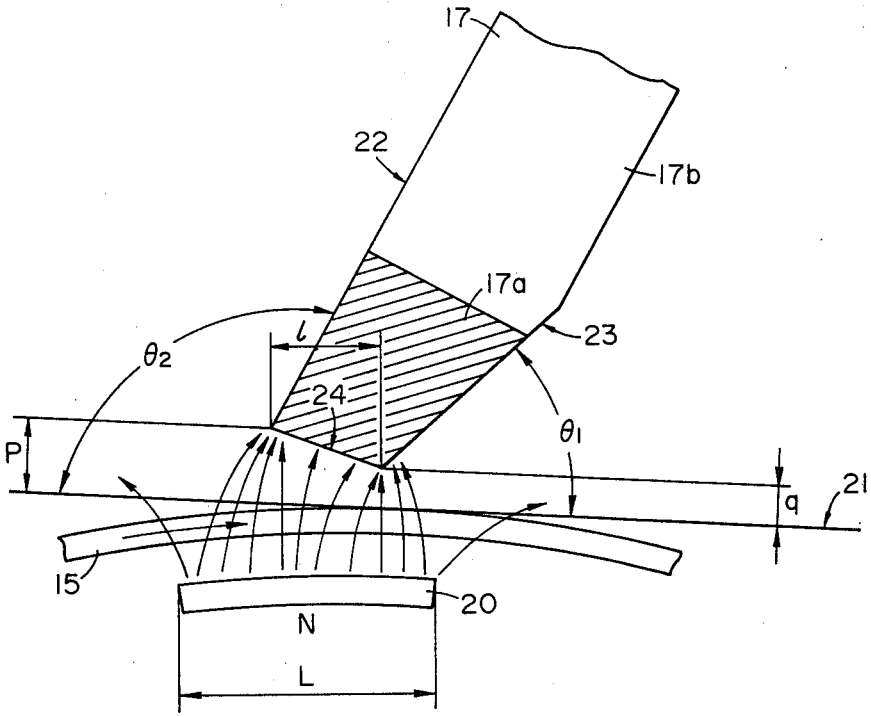
FIG. 7 is an enlarged view showing the positional relationship between the developer thickness regulating means and the developer bearing means.

FIG. 7 is an enlarged view of the toner layer thickness control means and its neighborhood area in the developing device applicable to the embodiment as described above. A reference numeral 20 designates a fixed magnet provided within the sleeve 15 in confrontation to the doctor blade, the magnetic pole (N) of which is directed toward the doctor blade. In this case, the magnetic lines of force due to the magnet 20 further reach the vicinity of the tip end of the tip end part 17*a* of the doctor blade 17 formed with a magnetic material. If the tip end part 17*a* of the doctor blade 17 is non-magnetic, there is exerted onto the magnetic toner particles only the force of attraction (magnetic force, electrostatic adsorption force, van der Waal's force, etc.) to the surface of the toner holding member with the consequence that the toner layer formed by rotation of the sleeve 15 becomes thick. Moreover, since the tip or ear of the toner brush frictionally slides vigorously with the doctor blade, there takes place a decrease or irregularity in the layer thickness (i.e., considerable non-uniformity in the thickness of the toner layer to be formed) due to adhesion of the toner to the blade. Incidentally, since the magnetic toner is subjected to force in the magnetic field at a portion where the density of the magnetic lines of force changes from sparse to dense, i.e., in the direction of the magnetic flux density gradient, if the tip end part 17*a* of the doctor blade is made of a magnetic material, the force of attraction of the magnetic toner to the doctor blade can be created, as detailed in the above-described embodiment, by not making the width L of the magnetic pole of the magnet 20 wider than the width l of the tip end 17*a* of the magnetic portion of the doctor blade 17. As a result, the toner can be possibly formed into a constant layer thickness which is smaller than the closest gap q between the doctor blade 17 and the sleeve 15. However, according to the experiments conducted by the present inventors, when the width l of the opposing surface 24 of the tip end of the doctor blade is smaller than 0.3 mm, irregularity in the toner layer tends to be readily generated. However, the coating is practically possible with the width l of 0.1 mm and above. This phenomenon is considered due to the fact that, since an attempt is made to obtain the force of attraction in a too narrow region, the magnetic flux density gradient becomes so steep that instability is introduced in the formation of the toner layer. On the other hand, when the tip end surface 24 of the doctor blade is separated from the sleeve surface by 0.3 mm and above, a favorable result can be obtained even when the closest point and the maximum distant point between the sleeve and the doctor blade are at any place on the tip end surface 24, provided that, even when the tip end surface 24 is not particularly flat, the closest distance q between the doctor blade and the sleeve and the maximum distance P between the contact plane 21 on the sleeve at such closest contact point and the tip end surface 24 are within reaching range of the magnetic force effective for forming the toner layer by the magnet 20 within the sleeve. Needless to say, the tip end surface may be in parallel with the abovementioned contact plane 21.

Further, according to the experiments by the present inventors using the magnetic blade having the abovementioned tip end surface, it has been found preferable that the following angular relationship be established: $\theta_2 > 90°$ and $\theta_1 \geqq 30°$ (where: $\theta_2$ is an angle formed by the toner entering surface 22 of the doctor blade and the abovementioned contact plane 21, and $\theta_1$ is an angle formed by the toner discharging surface 23 of the doctor blade and the contact plane 21). That is, by making $\theta > 90°$, a portion higher than the gap of the toner brush having a length longer than the toner entering gap between the sleeve and the doctor blade is no longer required to be unnecessarily pushed into the portion where the magnet is working, whereby coagulation among the toner particles can be prevented. When $\theta_1 < 30°$, the magnetic flux does not concentrate on the tip end at the toner discharging surface 30 of the doctor blade, whereby the toner layer thickness formed by the blade tends to become unstable and cause irregularity. It has been found out that, when $\theta \geqq 30°$, such irregularity can be removed.

When the magnetic blade of the abovementioned construction is used, there can be formed a very thin and uniform toner layer free from coagulation of the toner particles, adhesion of the toner particles to the blade, and scattering of the toner particles, because the toner layer is formed inside the critical region in the magnetic force reaching range, whereby a stable image can be obtained with a simple construction.

Figure 8:
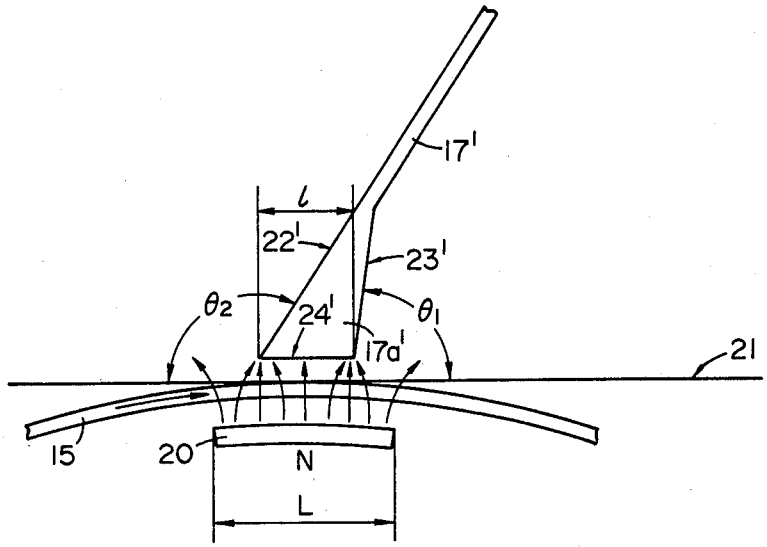
FIG. 8 is an explanatory diagram showing a modified embodiment shown in FIG. 7 above.

FIG. 8 shows a modified embodiment of the doctor blade in FIG. 7, wherein numerals 17', 22', 23' and 24' respectively correspond to the elements 17, 22, 23, and 24 in FIG. 7 with the exception that their configurations have been modified, although the functions are exactly the same as those in the previous embodiment, hence explanations are dispensed with.

Figure 9:
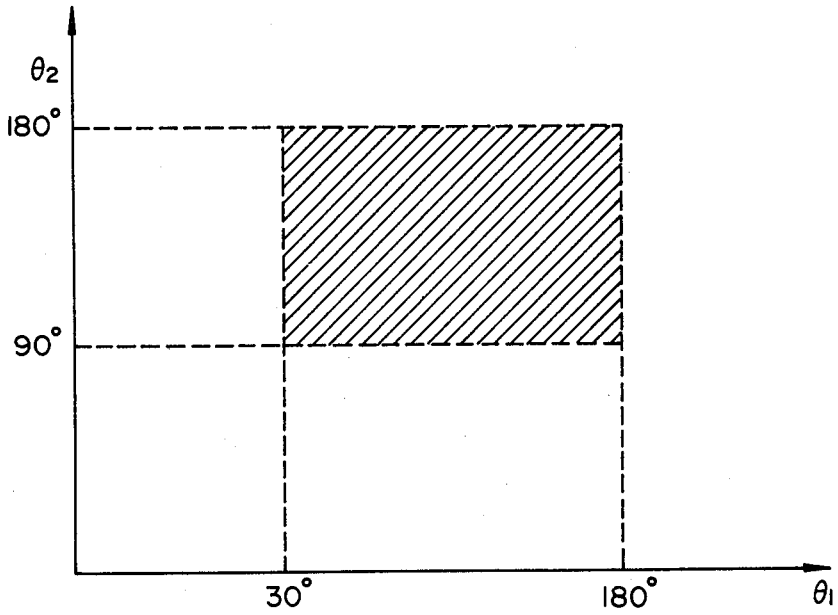
FIG. 9 is a graphical representation showing the range of established angle for developer entering surface and discharging surface of the developer thickness regulating means in the embodiments of the present invention.

FIG. 9 shows a preferable region of the abovementioned angles $\theta_1$ and $\theta_2$ of the doctor blade according to the present invention, by which a stable image is to be provided. In the drawing, the hatch-lined portion indicates such preferable region that has been obtained by the experiments.

In the following, one embodiment of the present invention will be explained.

As a method for developing by the use of one-component magnetic toner, there is such one that the toner is applied thinly and uniformly on the surface of the toner holding member, after which the toner applied surface is opposed to an electrostatic latent image with a gap therebetween which is greater than the toner layer thickness so as to move the toner in this gap for development (vide, for example, U.S. Ser. No. 58,435, filed July 18, 1979, now U.S. Pat. No. 4,292,387). According to this developing method, adhesion of the toner to the non-image portion is small and the gradation in the image is also satisfactory. In this developing method, widening of the gap between the toner layer and the electrostatic latent image is not preferable, because of flight of the toner particles by the electrostatic force due to the electrostatic latent image potential. The gap is of an order of a few hundred microns, or so. The toner layer thickness is required to be much thinner than this gap. Such very thin toner layer can be obtained readily and stably by the use of the developing device according to the present invention.

According to the experiments conducted by the present inventors, the following factors were used.

| | |
|---|---|
| Non-magnetic sleeve | non-magnetic stainless steel |
| Magnetic flux density of the fixed magnet at the surface of the enclosing sleeve | 1,000 gausses |
| Width of magnetic pole (L) | 5 mm |
| Thickness regulating member | flat surfaced iron plate |
| Width of the magnetic pole (l) | 0.5 mm |
| $\theta_1$ | 44° |
| $\theta_2$ | 112° |

The thickness regulating member is fixed in confrontation to the abovementioned magnetic pole with the closest point to the sleeve being provided at the toner discharging side of the tip end surface at the closest distance q of 300 microns from the sleeve.

The toner used consists of 3 parts by weight of styrene maleic acid as the resin component and 1 part by weight of magnetite, both of which are well mixed and pulverized to an average particle diameter of 8 microns or so. The toner layer, the thickness of which has been controlled, has a thickness of approximately 100 microns. When the sleeve and the photosensitive drum are rotated at an equal peripheral speed of 110 mm/sec. with a space gap therebetween of 300 microns, a favorable developed image can be obtained.

In the embodiments, according to the present invention, the thin and uniform toner layer is formed on the sleeve by: (1) effecting electric charging through friction between the sleeve and the toner particles (and among the toner particles per se) by use of insulative magnetic toner (such charging may further be assisted by corona discharge, etc.); (2) transferring the toner thus charged to a predetermined polarity from the surface of the sleeve by a latent image potential (the transfer of the toner can be further controlled by application of a bias electric field); (3) limiting the toner layer thickness to be controlled by the magnetic blade opposite to the sleeve to a few hundred microns which is thinner than the developing gap between the sleeve and the latent image bearing member; (4) rotating the sleeve, while fixing the magnet roll therein, to uniformly maintain the magnetic field intensity acting between the abovementioned magnetic blade and the magnet roll and distribution of the magnetic lines of force.

Accordingly, in comparison with the afore-described conventional method, a uniform and thin toner layer can be formed easily, whereby a developed image of satisfactory and homogeneous quality can be advantageously obtained.

Since the present invention provides the developing device of such construction as described above, which is suitable for operation with one-component magnetic toner, various remarkable effects can be derived therefrom such that the construction is simple, and it is free from scattering, coagulation, and adhesion of toner particles to any part of the developing device, so that favorable development can be carried out.

It goes without saying that the present invention is not limited to the embodiments as explained above. In addition, it is possible to apply a bias field to a gap between the sleeve and the latent image bearing surface.

Furthermore, the developing device according to the present invention is applicable not only to the development of the abovementioned electrostatic latent image, but also to a device, in which a magnetic latent image is formed on a magnetic recording medium and the image thus formed is developed with a magnetic developer.

What we claim is:

1. A developing device for forming a developed image on an image bearing member, comprising in combination:

(a) developer holding means having a developer holding surface adapted to oppose the image bearing member;

(b) means for supplying magnetic developer onto said developer holding surface;

(c) fixed magnetic field generating means disposed on the side of said developer holding means opposite to said developer holding surface; and (d) magnetic thickness regulating means disposed on the opposite side of said developer holding means from said magnetic field generating means and within the influence of the magnetic field of a magnetic pole of said magnetic field generating means, said magnetic thickness regulating means being provided with a tip facing said developer holding surface and having a width which is smaller than the width of said magnetic pole of said magnetic field generating means, said magnetic thickness regulating means being opposed to said magnetic pole of said magnetic field generating means across said developer holding means to concentrate the magnetic lines of force extending from said magnetic pole and thereby regulate the developer layer to a thickness smaller than the gap between said magnetic thickness regulating means and said developer holding means.

2. A developing device according to claim 1, wherein an angle $\theta_2$ formed by a flat contact surface in said developer holding means and a developer entrance surface of said magnetic thickness regulating means, at a point where said magnetic thickness regulating means and said developer holding means are closest to each other, is greater than 90°, and an angle $\theta_1$ formed by said flat contact surface and a developer discharging surface of said magnetic thickness regulating means is greater than 30°.

3. A developing device according to claim 1, wherein a relationship of $l \leqq L$ is satisfied, where l is the width of the tip end surface of said magnetic thickness regulating means, and L is a half-peak width of said magnetic pole.

4. A developing device according to claim 3, wherein the width l is selected from a range of 0.1 mm to 5 mm, and the width L is selected from a range of 0.1 mm to 15 mm so as to satisfy the relationship of $l \leqq L$.

5. A developing device according to claim 3, wherein the width l is selected from a range of 0.5 mm to 1 mm, and the width L is selcted from a range of 0.5 mm to 10 mm so as to satisfy the relationship of $l \leqq L$.

6. A developing device according to claim 1, wherein said magnetic thickness regulating means includes a doctor blade for regulating the thickness of the developer layer on said developer holding means.

7. A developing device according to claim 1, wherein said magnetic thickness regulating means is mounted on a end of a doctor blade for regulating the thickness of the developer layer on said developer holding means.

8. A developing device according to claim 1, wherein the end surface of said magnetic thickness regulating means facing said developer holding means is parallel to the tangent plane of said developer holding means at the portion opposed to said magnetic thickness regulating means.

9. A developing device according to claim 1, wherein the clearance between said magnetic thickness regulating means and said developer holding means decreases in the direction that the developer passes through the clearance.

* * * * *